US005220335A

United States Patent [19]

Huang

[11] Patent Number: 5,220,335

[45] Date of Patent: Jun. 15, 1993

[54] PLANAR MICROSTRIP YAGI ANTENNA ARRAY

[75] Inventor: John Huang, Arcadia, Calif.

[73] Assignee: The United States of America as represented by the Administrator of the National Aeronautics and Space Administration, Washington, D.C.

[21] Appl. No.: 664,445

[22] Filed: Feb. 28, 1991

Related U.S. Application Data

[63] Continuation-in-part of Ser. No. 501,892, Mar. 30, 1990, abandoned.

[51] Int. Cl.[5] ..... H01Q 1/380; H01Q 19/300; H01Q 21/00

[52] U.S. Cl. ..... 343/700 MS; 343/819; 343/833; 343/834

[58] Field of Search ..... 343/700 MS, 705, 708, 343/815-820, 833, 834

[56] References Cited

U.S. PATENT DOCUMENTS

| | | | |
|---|---|---|---|
| Re. 29,911 | 2/1979 | Munson | 343/700 MS |
| 3,968,458 | 7/1976 | McGowan | 333/24.2 |
| 3,978,488 | 8/1976 | Kaloi | 343/700 MS |
| 3,984,834 | 10/1976 | Kaloi | 343/700 MS |
| 4,040,060 | 8/1977 | Kaloi | 343/700 MS |
| 4,054,874 | 10/1977 | Oltman, Jr. | 343/700 MS |
| 4,118,706 | 10/1978 | Kerr | 343/700 MS |
| 4,125,837 | 11/1978 | Kaloi | 343/700 MS |
| 4,218,686 | 8/1980 | Blonder | 343/819 |
| 4,347,517 | 8/1982 | Kaloi | 343/700 MS |
| 4,370,657 | 1/1983 | Kaloi | 343/700 MS |
| 4,415,900 | 11/1983 | Kaloi | 343/700 MS |
| 4,547,779 | 10/1985 | Sanford et al. | 343/700 MS |
| 4,639,732 | 1/1987 | Acoraci et al. | 342/371 |
| 4,684,952 | 8/1987 | Munson et al. | 343/700 MS |
| 4,719,470 | 1/1988 | Munson | 343/700 MS |
| 4,724,441 | 2/1988 | Fithian et al. | 342/368 |
| 4,849,765 | 7/1989 | Marko | 343/702 |
| 5,008,681 | 4/1991 | Cavallaro et al. | 343/700 MS |

FOREIGN PATENT DOCUMENTS

| | | | |
|---|---|---|---|
| 0655486 | 1/1963 | Canada | 343/705 |
| 0360692 | 3/1990 | European Pat. Off. . | |
| 0276903 | 11/1988 | Japan | 343/700 |
| 8907838 | 8/1989 | World Int. Prop. O. . | |

OTHER PUBLICATIONS

Yagi Arrays, Chapter 11 of the ARRL Antenna Book, pp. 11-1 to 11-27, Newington, Conn., 1988.

J. Huang, Planar Microstrip Yagi Array Antenna, Int. Symp. Digest Antennas & Propagation, Jun. 26-30, 1989, pp. 894-897.

Rana et al., Theory of Microstrip Yagi-Voa Arrays, Radio Science, vol. 16, No. 6, Nov.-Dec., 1981, pp. 1077-1079.

Lee et al., Microstrip Antenna Array with Parasitic Elements, IEEE AP-S Symposium Digest, Jun., 1987, pp. 794-797.

(List continue on next page.)

*Primary Examiner*—Rolf Hille
*Assistant Examiner*—Peter Toby Brown
*Attorney, Agent, or Firm*—John H. Kusmiss; Thomas H. Jones; Guy M. Miller

[57] ABSTRACT

A directional microstrip antenna includes a driven patch surrounded by an isolated reflector and one or more coplanar directors, all separated from a groundplane on the order of 0.1 wavelength or less to provide endfire beam directivity without requiring power dividers or phase shifters. The antenna may be driven at a feed point a distance from the center of the driven patch in accordance with conventional microstrip antenna design practices for H-plane coupled or horizontally polarized signals. The feed point for E-plane coupled or vertically polarized signals is at a greater distance from the center than the first distance. This feed point is also used for one of the feed signals for circularly polarized signals. The phase shift between signals applied to feed points for circularly polarized signals must be greater than the conventionally required 90° and depends upon the antenna configuration.

9 Claims, 3 Drawing Sheets

OTHER PUBLICATIONS

Long and Walton, "A Dual-Frequency Stacked Circular Disc Antenna", IEEE Trans. Antenna and Propogation, Col. AP-27, Mar., 1979.

Haneishi et al., "Beam Shaping of Microstrip Antenna by Parasitic Elements having Coacial Stub", Trans. IECE of Japan, vol. 69-B, pp. 1160-1161.

H. Yagi, "Beam Transmission of Ultra Short Waves", Proc. IRE, vol. 16, pp. 715-741, Jun., 1928.

Chen and Cheng, "Optimum Element Lengths for Yagi-Uda Arrays", IEEE Trans. Antennas and Propagation, vol. AP-23, Jan., 1975.

Haneishi et al. Shaped-Beam Planar Antenna using Microstrip Antenna with Open-Circuited Stub, Saitama National University, Urawa-shi, Saitama, Japan.

PLANAR MICROSTRIP YAGI ANTENNA ARRAY

ORIGIN OF THE INVENTION

The invention described herein was made in the performance of work under a NASA contract, and is subject to the provisions of Public Law 96-517 (35 USC 202) in which the Contractor has elected not to retain title.

CROSS REFERENCE TO ORIGINAL APPLICATION

This application is a continuation-in-part of application Ser. No. 07/501,892, filed Mar. 30, 1990, now abandoned.

TECHNICAL FIELD

The present invention relates to antennas and in particular to planar microstrip antenna structures.

BACKGROUND OF THE INVENTION

In conventional microstrip antenna array configurations, mutual coupling between antenna elements is often considered undesirable because such coupling typically reduces antenna gain and diverts antenna power into unwanted sidelobes. However, in several known microstrip antenna configurations, mutual coupling has been used for specific effects between the driven antenna element and parasitic patches.

The article entitled "Microstrip Antenna Array with Parasitic Elements", by K. F. Lee et al., published in IEEE AP-S SYMPOSIUM DIGEST, Jun., 1987, pp 794–797, shows the use of parasitic patches placed around a single driven element to increase the gain by several decibels.

The article by S. A. Long and M. D. Walton entitled "A Dual-Frequency Stacked Circular Disc Antenna", published in IEEE Trans. Antenna and Propagation, Col. AP-27, Mar. 1979 shows the use of stacked parasitic patches developed to enhance the bandwidth of a microstrip radiator.

Parasitic patches with open circuit stubs have been used to shape the beam of an antenna so that its peak can be tilted in a desired direction as shown in the article by M. Haneishi et al., entitled "Beam-Shaping of Microstrip Antenna by Parasitic Elements having Coaxial Stub" published in Trans. IECE of Japan, vol. 69-B, pp 1160–1161, 1986.

In order to modify beam patterns, conventional microstrip array antennas often utilize power dividers and/or phase delay transmission lines, or the equivalent, which reduce array efficiency and increase array size.

Highly directional dipole antenna configurations are well known, such as the YAGI dipole antenna described originally in the article entitled "Beam Transmission of Ultra Short Waves" by H. Yagi in Proc. IRE, vol. 16, pp 715–741, Jun. 1928. Yagi antennas produce substantial directivity by use of parasitic director and reflector dipoles coplanar with the driven dipole. Ground planes, when used with Yagi antennas, must typically be positioned at least one quarter wavelength away from the plane of the elements to prevent unwanted cancellation between the radiated signal and the reflected signals from the groundplane.

The physical configuration of conventional Yagi dipole arrays are discussed, for example, in the article by C. A. Chen and D. K. Cheng entitled "Optimum Element Lengths for Yagi-Uda Arrays" published in IEEE Trans. Antennas and Propagation, vol. AP-23, Jan. 1975.

The current trends in antenna designs, such as those required by mobile, satellite linked communications systems, result in a need for low profile, directional microstrip antenna configurations which can conveniently be made to conform to the shape of the mobile unit, such as an airplane wing, while providing the highly directional antenna patterns achievable with other antenna configurations, such as those achievable with Yagi dipole antenna arrays.

BRIEF STATEMENT OF THE INVENTION

The preceding and other shortcomings of the prior art are addressed and overcome by the present invention that provides, in a first aspect, a directional microstrip antenna including a dielectric substrate having first and second surfaces, a groundplane on the first surface of the substrate and a driven patch on the second surface of the substrate, the separation between the driven patch and the groundplane being on the order of 0.1 wavelengths or less, an isolated reflector patch coplanar with the driven patch on one side thereof for mutual coupling therebetween, the center to center distance between the driven and reflector patches being on the order of 0.35 free space wavelength, and one or more isolated director patches coplanar with the driven patch on the side opposite the side adjacent the reflector patch, the center to center distance between the driven and director patch being on the order of 0.30 free space wavelength so that the antenna beam is tilted toward an axis of the antenna array by the parasitic coupling across gaps between the driven and isolated patches.

In another aspect, the present invention provides a method of tilting the beam of a microstrip antenna toward the antenna array axis by driving a driven patch separated by a dielectric about 0.1 wavelength or less from a groundplane, parasitically coupling a larger reflector patch to the driven patch, the center to center distances between the patches being about 0.35 free space wavelength, and parasitically coupling a smaller director patch to the driven patch on the side opposite the reflector patch, the center to center distances between the driven and director patches being about 0.30 free space wavelength.

These and other features and advantages of this invention will become further apparent from the detailed description that follows which is accompanied by a set of drawing figures. In the figures and description, numerals indicate the various features of the invention, like numerals referring to like features throughout both the drawings and the description.

BRIEF DESCRIPTION OF THE DRAWING(S)

DETAILED DESCRIPTION OF THE INVENTION

Figure 1:
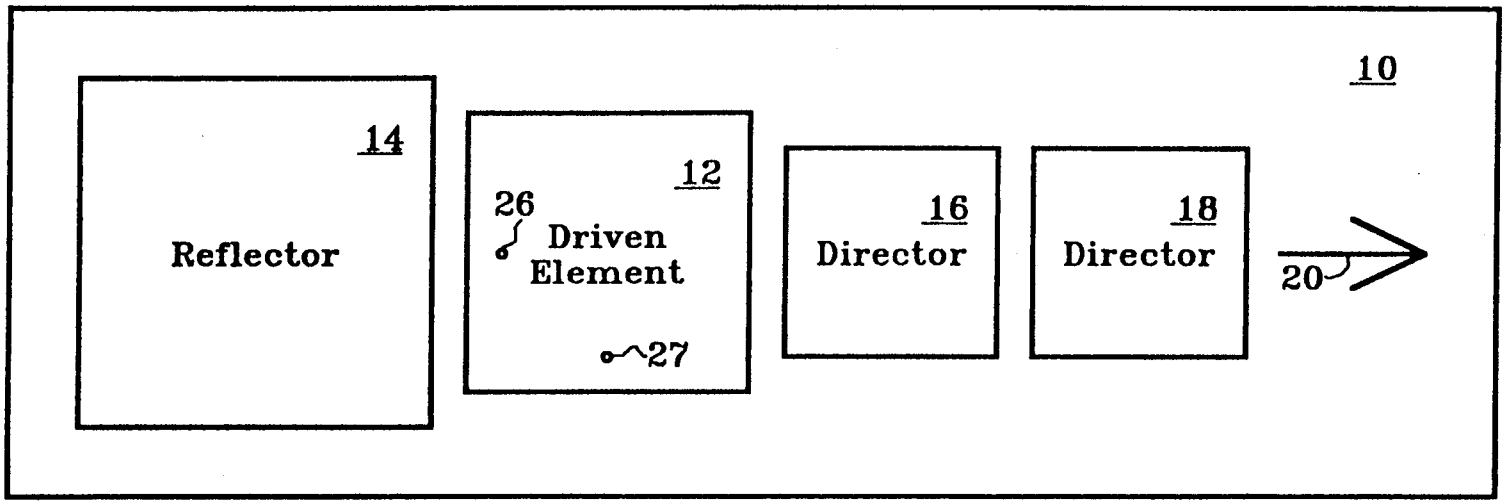
FIG. 1 is a top view of a circularly polarized, directional planar microstrip array antenna according to the present invention.

Referring now to FIG. 1, planar microstrip array antenna 10 includes driven element 12 located in the same plane with isolated parasitic reflector patch 14 and isolated parasitic director patches 16 and 18. As will be discussed below in greater detail, parasitic reflector patch 14 and parasitic director patches 16 and 18 mutually coupled with driven element 12 to tilt the peak beam of the antenna pattern of planar microstrip array antenna 10 toward the endfire direction, that is, toward antenna array axis in the direction indicated by endfire arrow 20.

Figure 2:
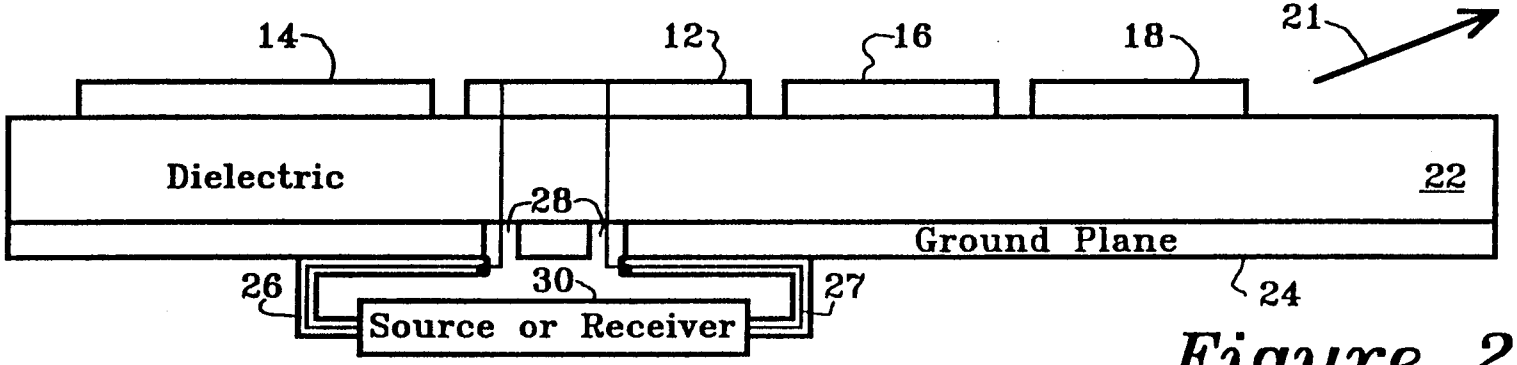
FIG. 2 is a side view of the planar microstrip array antenna shown in FIG. 1.

Referring now to FIG. 2, driven element 12, parasitic reflector patch 14 and parasitic director patches 16 and 18 are positioned on dielectric substrate 22, the opposite surface of which is covered by groundplane 24. Signal power may be applied to driven element 12 by coaxial feed 26. The outside conductor of coaxial feed 26 is electrically connected to groundplane 24 while the center conductor passes through isolating hole 28 therein and penetrates dielectric substrate 22 for connection to driven element 12. For circularly polarized signals, the second required signal, with a predetermined difference in phase, may be applied to driven element 12 by additional coaxial feed 27 in a similar manner.

The difference in phase between the signals on coaxial feeds 26 and 27, and the placement of the connection between coaxial feed 26 and driven element 12, will be described below in greater detail with reference to FIGS. 3 and 4.

Coaxial feeds 26 and 27 are connected to receiver/-transmitter 30 which may be a source, and/or user, of signal power as required by the application of planar microstrip array antenna 10. Driven element 12 may also be connected to signal power by conventional microstrip transmission line conducting paths, not shown.

The power dividers and phase delay transmission lines associated with conventional microstrip antenna arrays with parasitic patches are not required with planar microstrip array antenna 10. This permits increased array efficiency.

The physical configuration of planar microstrip array antenna 10 is similar to that of a conventional dipole Yagi array in that at least one of the dimensions of driven patch element 12, parasitic director patches 16 and 18 and parasitic reflector patch 14 does not vary substantially from conventional dimensions used for Yagi dipole arrays. In particular, at least one dimension of driven patch 12 must be about one half wavelength long at the operating frequency of the antenna, one dimension of parasitic reflector patch 14 must be longer than such dimension of driven patch 12 while one dimension of parasitic director patches 16 and 18 must be shorter than that dimension of driven patch 12.

Driven element 12 is a square microstrip patch sized to resonate at about the center frequency of circularly polarized microstrip array antenna 10 in accordance with conventional microstrip antenna design principles. Each dimension of driven patch 12 is therefore about one half wavelength long in dielectric substrate 22 at the operating frequency of the antenna array. Parasitic director patches 16 and 18 are square patches sized to resonate at a slightly higher frequency while parasitic reflector patch 14 resonates at a slightly lower frequency. Reflector patch 14 will therefore be slightly larger than driven patch 12 while director patches 16 and 18 will be slightly smaller than driven patch 12.

These relationships between the sizes and resonant frequencies of patches 12, 14, 16, and 18 in the present invention are similar to the relationships between the dipoles in a conventional Yagi dipole antenna.

The phase changes coupled from driven patch 12 to higher resonant frequency parasitic director patches 16 and 18 tend to tilt the antenna pattern from the broad beam direction toward endfire arrow 20 along the axis of the antenna array to tilted beam axis 21. The phase change coupled from driven element 12 to lower resonant frequency parasitic reflector patch 14 is from the opposite side and with a different phase than those from parasitic director patches 16 and 18 so that the resultant combined beam is tilted to beam axis 21 by the coupling with both types of parasitic patches.

Experimental results have shown that, depending upon the thickness and dielectric constant of dielectric substrate 22, the ratio of the width dimensions of parasitic reflector patch 14 and driven element 12 should be in the range of 1.1:1 to 1.3:1. Similarly, the ratio of width dimensions between driven element 12 and parasitic director patches 16 and 18 should be between 1:0.8 and 1:0.95, parasitic director patches 16 and 18 being equal in size.

The distance between the centers of parasitic reflector patch 14 and driven element 12 should be on the order of 0.35 free space wavelength, while the separation between the center of driven element 12 and the first parasitic director patch 16 should be on the order of 0.3 free space wavelength. The distance between centers of the parasitic director patches 16 and 18 should result in the same gap between the director patches as between driven element 12 parasitic and director patch 16.

The dielectric constant of dielectric substrate 22 is also an important design feature. The dielectric constant of dielectric substrate 22 can neither be too low nor too high. If the relative dielectric constant of the substrate is less than about 1.5, the required patch size becomes larger than 0.35 free space wavelength and consequently the above required center to center separation distance can no longer hold. On the other hand, if the dielectric constant is above about 5, the patches become very small in area and the gaps between them become large. This tends to reduce the mutual coupling required for performance. In general, it has been found that the separation and patch size govern the phase, while the gap governs the amplitude.

The gaps should be on the order of the thickness of dielectric substrate 22 or smaller, that is, not greater than the distance between the groundplane and the plane of the antenna elements. This distance must be very small, in the range of only about 0.1 wavelength, for many of the applications of a directional microstrip antenna configured according to the present invention. As noted above, the dielectric constant of microstrip dielectric substrate 22 is in the range of about 1.5 to 5. The effective wavelength of the separation of the plane of the antenna elements from groundplane 24 will therefore be substantially smaller than 0.1 free space wavelength at the operating frequency of microstrip antenna 10.

The physical configuration of a circularly polarized antenna, resonant at 1.58 GHz and constructed according to the current invention, will now be described. Parasitic reflector patch 14 was 2.5 inches square, driven element 12 was 2.2 inches square and parasitic director patches 16 and 18 were 2.00 inches square. The gap distances between all patches were kept constant at 0.11 inches. Dielectric substrate 22 was chosen to have a relative dielectric constant of 2.5 and a thickness of 0.25 inches.

During operation of planar microstrip array antenna 10 configured in accordance with the model described above, the beam peak was tilted 40° from the normal broadside direction. Although the peak gain of this model at 8 dBi was not substantially higher than that of a driven element 12 alone, 3 to 5 dB more directivity was achieved between 80° and 40° from the broadside direction.

The physical configuration of another circularly polarized antenna, also resonant at 1.58 GHz and constructed according to the current invention, will now be described. Parasitic reflector patch 14 was 3.00 inches square, driven element 12 was 2.55 inches square and parasitic director patches 16 and 18 were 2.3 inches square. The gap distances between all patches were kept constant at 0.10 inches. Dielectric substrate 22 was chosen to have a relative dielectric constant of 1.8 and a thickness of 0.25 inches.

During operation of planar microstrip array antenna 10 configured in accordance with the model described above, the beam peak was tilted 30° from the normal broadside direction, achieving about 2.5 dB of higher peak directivity than the driven element 12 achieved when operated alone.

Figure 3:
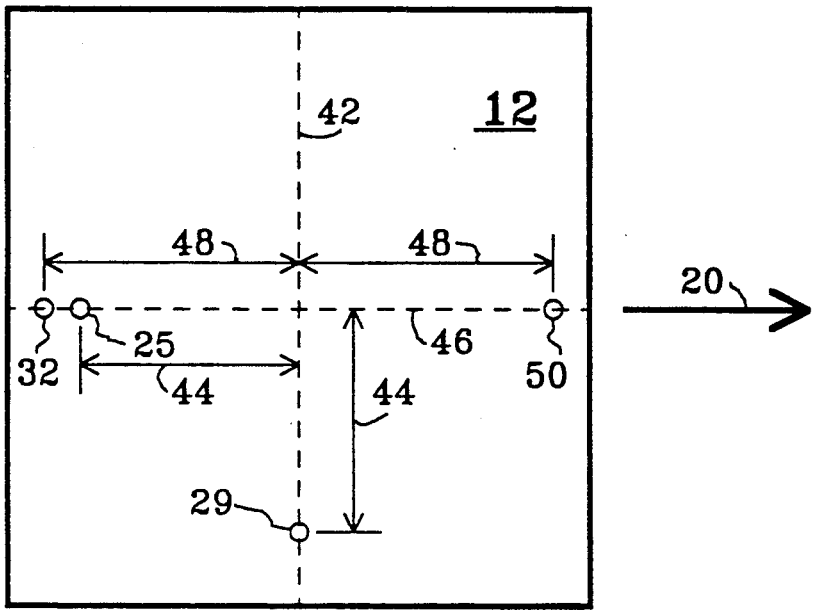
FIG. 3 is an enlarged plan view of the driven patch of the antenna shown in FIG. 1.
Figure 4:
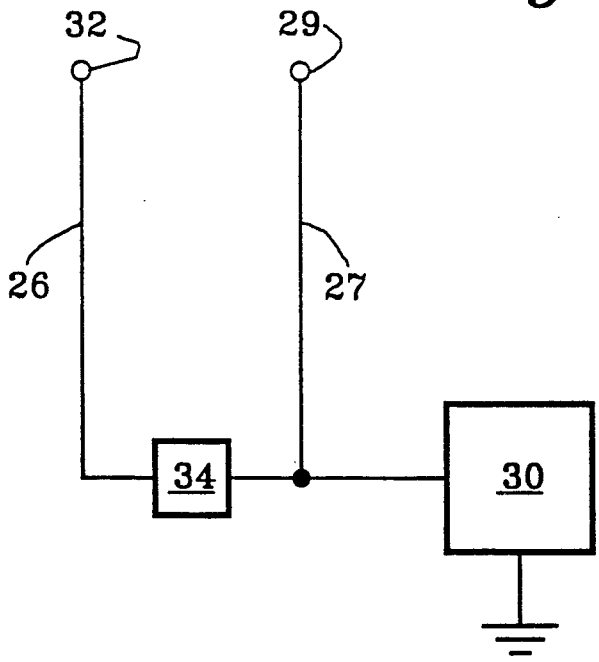
FIG. 4 is a block diagram schematic illustration of the connections between the receiver/transmitter and the coaxial feeds used for driving the patch shown in FIG. 3.

Referring now to FIGS. 3 and 4, the position of the feed point connections of coaxial feeds 26 and 27 to driven patch 12 will now be discussed in greater detail. In accordance with conventional microstrip antenna design practice, feed point 29 for coaxial feed 27 would be selected along midline 42 of driven patch 12 at distance 44 so that the impedance of feed point 29 matches that of the coaxial feed 27, typically 50 ohms.

In accordance with conventional microstrip antenna design practice, coaxial feed 26 would be connected to driven element 12 at feed point 25 at the same distance 44 along midline 46 from the center of driven element 12. In accordance with the present invention, however, it has been found that the parasitic coupling of parasitic reflector patch 14 and parasitic director patches 16 and 18 to driven element 12 lowers the impedance of feed point 25 at distance 44 from the center of driven element 12.

Coaxial feed 26 is therefore connected to driven element 12 at feed point 32 which is at distance 48 from the center of driven element 12. Distance 48 is greater than distance 44. Distance 48 may be determined by trial and error or measurement of the impedance along midline 46 from the center of driven element 12. Coaxial feed 16 may alternatively be connected to driven element 12 at feed point 50 which is also at distance 48 from the center of driven element 12.

It is important to note that for circularly polarized signals, the distances between the center of driven element 12 and the appropriate feed points 32 and 29 must be different in order to obtain the same impedance. If the distances are equal, as normally required by conventional microstrip antenna design considerations, the impedances will not be equal, making it more difficult to achieve maximum coupling efficiency without additional mechanisms for impedance matching.

Referring now specifically to FIG. 4, the mutual coupling between driven and parasitic patches requires a second departure from conventional microstrip design practices related to the phase shift required between coaxial feed 26 and coaxial feed 27. In conventional practice, a 90° phase shift is inserted between coaxial feeds 26 and 27. In accordance with the present invention, it has been determined that the phase shift between these feeds should be different than 90° in order to maintain the proper axial ratio in the resultant circularly polarized signal.

In particular, receiver/transmitter 30 drives patch 12 directly through coaxial feed 27 at feed point 29. Receiver/transmitter 30 drives patch 12 through coaxial feed 26 at feed point 32, after a phase shift has been added by phase shift circuit 34. In a conventional microstrip antenna, phase shift circuit 34 would typically be a 90° phase shift circuit, commonly called a 90° hybrid. In the present invention, phase shift circuit 34 must provide more than a 90° phase shift in order to maintain an acceptable axial ratio in the resultant beam. In accordance with a preferred embodiment of the present invention, phase shift circuit 34 provides a phase shift in the range of about 115°. The magnitude of the phase shift required between feeds for any particular directional microstrip antenna array configuration may have to be determined empirically.

Figure 5:
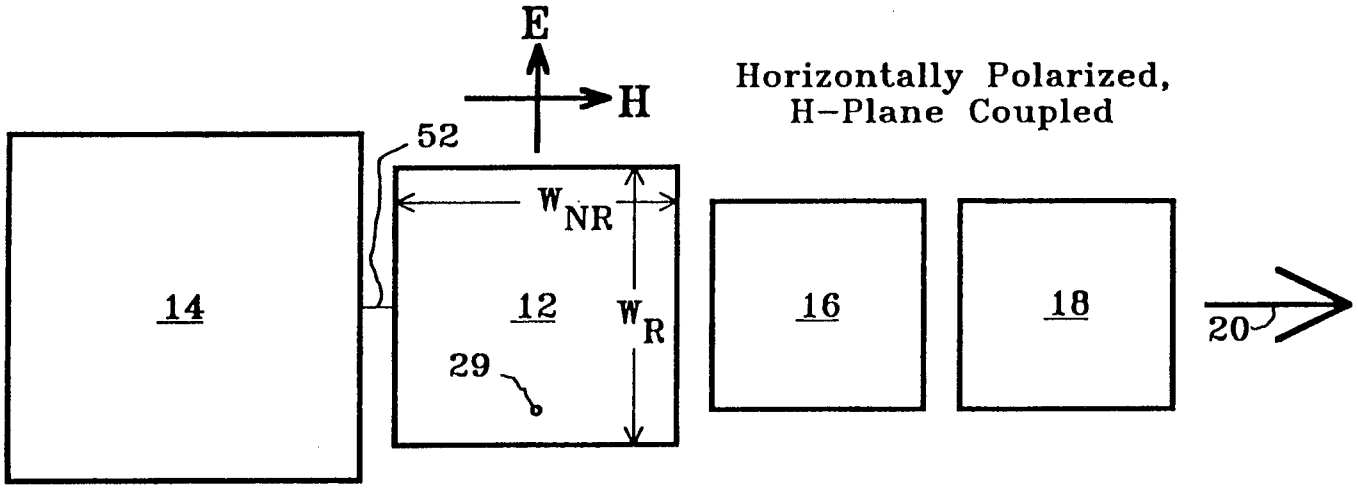
FIG. 5 is a view of a horizontally polarized, H-plane coupled direction microstrip array in accordance with the present invention.
Figure 6:
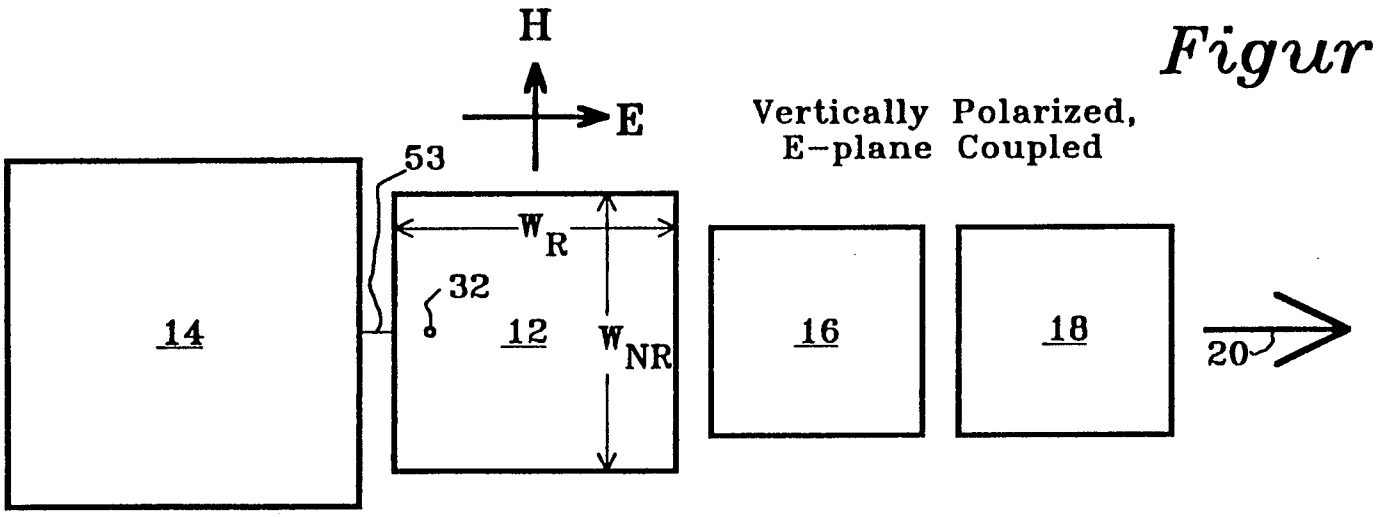
FIG. 6 is a view of a vertically polarized, E-plane coupled direction microstrip array in accordance with the present invention.

Instead of driving patch 12 with both coaxial feed 26 and coaxial feed 27 to produce circularly polarized radiation, patch 12 may be driven by either of these feeds alone. If patch 12 is driven only by coaxial feed 27 as shown in FIG. 5, an H-plane coupled beam pattern will result. If patch 12 is driven only by coaxial feed 26 as shown in FIG. 6, an E-plane coupled beam pattern will result. Assuming that the plane of the antenna array elements is horizontal, the antenna beam pattern from the antenna shown in FIG. 5 would be horizontally polarized, that is, polarized in a plane parallel to the plane of the antenna array, while the antenna beam pattern from the antenna shown in FIG. 6 would be vertically polarized, that is, polarized in a plane orthogonal to the plane of the antenna array.

Referring now to FIG. 5, patch 12 may be driven only at feed point 29 for horizontally polarized signals. The resonant dimension for feed point 29, shown as resonant width $W_R$ in FIG. 5, is transverse to antenna axis 20 and must nominally be one half wavelength as noted above. The non-resonant dimension of patch 12, shown as non-resonant width $W_{NR}$, may vary somewhat from one half wavelength for horizontally polarized signals in accordance with bandwidth and other considerations as long as the center to center distances between the patches are maintained to maintain the required phase differences.

If patch 12 is not square, non-resonant width $W_{NR}$ must at least be large enough so that substantial parasitic H-plane coupling between driven patch 12 and adjacent reflector and director patches 14 and 16 occurs across the gap between these patches to permit significant surface wave coupling therebetween. This surface wave coupling is shown as H-plane coupling 52 in FIG. 5. A width in the range of about 0.4 to 0.6 wavelength in dielectric substrate 22 for non-resonant width $W_{NR}$ has been found to be satisfactory. The dimensions of the square or rectangular parasitic patches may be selected in a similar manner.

The physical configuration of a linearly polarized H-plane coupled antenna as shown in FIG. 5, resonant at 6.9 GHz and constructed according to the current invention, will now be described. Parasitic reflector patch 14 was 0.65 inches square, driven element 12 was 0.495 inches square and parasitic director patches 16 and 18 were 0.46 inches square. The gap distances between all patches was kept constant at 0.015 inches. Dielectric substrate 22 was chosen to have a relative dielectric constant of 2.2 and a thickness of 0.031 inches.

During operation of planar microstrip array antenna 10 configured in accordance with the model described above, the beam peak was tilted 35° from the normal broadside direction with its 3 dB points at 55° and 5° from the broadside. This model had a peak gain of 8 dBi and was 2 dB above the peak of the single patches radiation. Threeto five dB higher gain was achieved by planar microstrip array antenna 10 configured in accordance with this model in the region between 70° and 30° from the broadside direction.

Referring now to FIG. 6, patch 12 may be driven only at feed point 32 for vertically polarized signals. The resonant dimension for feed point 32, shown as resonant width $W_R$ in FIG. 6, is along antenna axis 20 and must nominally be about one half wavelength as noted above. The non-resonant dimension of patch 12, shown as non-resonant width $W_{NR}$, may vary somewhat from one half wavelength for vertically polarized signals in accordance with bandwidth and other considerations.

If patch 12 is not square, non-resonant width $W_{NR}$ must at least however be large enough so that substantial surface wave coupling, shown in FIG. 6 as parasitic E-plane coupling 53, occurs across the gap between driven patch 12 and adjacent reflector and director patches 14 and 16. A width in the range of about 0.4 to 0.6 wavelength in dielectric substrate 22 for non-resonant width $W_{NR}$ has been found to be satisfactory. The dimensions of the square or rectangular parasitic patches may be selected in a similar manner.

While this invention has been described with reference to its presently preferred embodiment, its scope is not limited thereto. Rather, such scope is only limited insofar as defined by the following set of claims and includes all equivalents thereof.

What is claimed is:

1. A directional microstrip array antenna comprising:

a dielectric substrate having first and second surfaces;

a group plane on the first surface of the substrate;

a square driven patch on the second surface of the substrate connected to a source or receiver of power, the separation between said driven patch and said groundplane being 0.1 wavelength or less;

a square isolated reflector patch coplanar with the driven patch on one side thereof for mutual coupling there between, the center to center distance between the driven and reflector patches being 0.35 free space wavelength;

a square first isolated director patch coplanar with the driven patch on the side opposite said one side of said reflector patch, the center to center distance between the driven and director patches being 0.30 free wavelength;

first feed point means for applying a first signal along a midline of the driven patch transverse to an antenna array axis at a first distance from the center of the driven patch; and second feed point means for applying a second signal along a midline of the driven patch parallel to the antenna array axis at a second distance from the center of the driven patch, said first and second distances being different and said second signal having a phase shift relative to said first signal in the range of 115° so that the antenna is circularly polarized, whereby the antenna beam is tilted toward the axis of the antenna array by the parasitic coupling across gaps between the driven and isolated patches.

2. The directional microstrip antenna claimed in claim 1, wherein the second distance is greater than the first distance and selected so that the impedances of the driven patch at the points of signal application are equal.

3. The directional microstrip antenna claimed in claim 1, further comprising:

means for producing the second signal by applying a phase shift in the range of 115° to the first signal.

4. The directional microstrip antenna claimed in claim 1 further comprising:

a second director patch coplanar with the first director patch, wherein the first and second director patch each have a size and the first director patch is separated from the driven patch by a first gap dimension and the second director patch is separated from the first director patch by a second gap dimension and the size of the second director patch is equal to the size of the first director patch and the first gap dimension is equal to the second gap dimension.

5. The directional microstrip antenna claimed in claim 1 wherein:

the ratio between the size of the reflector patch and the size of the driven patch is between 1.1:1 and 1.3:1.

6. The directional microstrip antenna claimed in claim 1 wherein:

the ratio between the size of the driven patch and the size of the director patch is between 1:0.8 and 1:0.95.

7. The directional microstrip antenna claimed in claim 1 wherein:

the relative dielectric constant of the dielectric substrate is in the range between 1.5 and 5.0.

8. A method of tilting the beam of a microstrip array antenna toward an axis of the array, comprising the steps of:

driving a square driven patch separated by a dielectric 0.1 free space wavelength or less from a groundplane;

parasitically coupling a larger square reflector patch to the driven patch, the center to center distances between the patches being 0.35 free space wavelength;

parasitically coupling a smaller square director patch to the driven patch on the side opposite the reflector patch, the center to center distances between the driven and director patches being 0.30 free space wavelength;

applying a first signal along a midline of the driven patch transverse to the antenna array axis at a first distance from the center of the driven patch; and applying a second signal along a midline of the driven patch parallel to the antenna array axis at a second distance from the center of the driven patch, said first and second distances being different and said second signal having a phase shift relative to said first signal in the range of 115° so that the antenna is circularly polarized.

9. The method of tilting the beam of a microstrip antenna claimed in claim 8, wherein the second distance is greater than the first distance and selected so that the impedances of the driven patch at the points of signal application are equal.

* * * * *

UNITED STATES PATENT AND TRADEMARK OFFICE

CERTIFICATE OF CORRECTION

PATENT NO. : 5,220,335

DATED : Jun. 15, 1993

INVENTOR(S) : John Huang

It is certified that error appears in the above-identified patent and that said Letters Patent is hereby corrected as shown below:

In Claim 1, line 53 of Column 7 should read "a ground plane on the first surface of the substrate;".

Signed and Sealed this

Twentieth Day of December, 1994

*Attest:*

Bruce Lehman

BRUCE LEHMAN

*Attesting Officer*

*Commissioner of Patents and Trademarks*